United States Patent [19]

Atanasov et al.

[11] Patent Number: 4,585,531

[45] Date of Patent: Apr. 29, 1986

[54] COMPOSITION INCLUDING AN ADDITIVE TO SULPHAMATE ELECTROLYTES FOR DEPOSITING HARD NICKEL LAYERS AND METHOD OF USING SAME

[75] Inventors: Nikolay A. Atanasov; Lyudmil G. Lyutov; Vera V. Mircheva; Stefan R. Stefanov, all of Sofia, Bulgaria

[73] Assignee: Institute po Phisikochimia, Sofia, Bulgaria

[21] Appl. No.: 752,443

[22] Filed: Jul. 3, 1985

[51] Int. Cl.[4] ..... C25D 3/12; C25D 3/18

[52] U.S. Cl. ..... 204/49

[58] Field of Search ..... 204/49, 44.5, 112

[56] References Cited

U.S. PATENT DOCUMENTS 3,990,955 11/1976 Dill ..... 204/49
4,049,509 9/1977 Such et al. ..... 204/49

FOREIGN PATENT DOCUMENTS 1189378 10/1959 France ..... 204/49
1052028 12/1966 United Kingdom ..... 204/49

*Primary Examiner*—G. L. Kaplan

[57] ABSTRACT

There is added to sulphamate electrolytes for depositing hard nickel layers based on nickel sulphamate an additive comprising of boric acid, nickel chloride and a surface-active substance which represents a derivative of sulphamoylbenzoic acid with the general formula

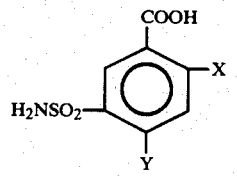

in which X and Y are hydrogen, halogen,

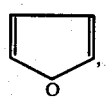

alkyl radical or a mixture of these compounds in a concentration from 0.1 to 4 g/l. These hard nickel layers are used in the manufacture of matrices for different work-pieces.

7 Claims, No Drawings

COMPOSITION INCLUDING AN ADDITIVE TO SULPHAMATE ELECTROLYTES FOR DEPOSITING HARD NICKEL LAYERS AND METHOD OF USING SAME

The invention relates to a composition including an additive to sulphamate electrolytes for depositing hard nickel layers used in the manufacture of matrices for processing plastics, printing blocks, securities, cylinders or wall-paper printing, carpets, screen printing, cutting and press tools, workpieces for instrumental design, fine mechanics and optics, etc. The invention also includes the method of using such composition.

Electrolytes based on nickel sulphamate, boric acid, nickel chloride and an antipitting additive are known, in which, in order to obtain layers with high hardness there are added to the electrolyte saccharin (1), 1, 3, 6-naphthalenetrisulphonic acid (2), coumarin etc. (3) See (1) U.S. Pat. No. 3,990,955, (2) U.S. Pat. No. 4,049,509, and (3) Dams B, Rolf R., Metalloberflache, No. 35/1981/10.

However, along with high hardness, these additives diminish considerably the plasticity of the layers obtained, and very often cause internal tensile stresses which is undesirable in depositing coatings with a thickness of several mm. Other drawbacks of these additives are their high initial concentrations, their great consumption, their complicated and expensive synthesis, as well as the fact that they are carcinogenic (coumarin). The insertion of considerable amounts of sulphur in the layer in using these additives causes an increased brittleness of the layer at high temperatures and a corrosion instability.

The object of the invention is to provide a surface-active additive to the electrolytes for sulphamate nickeling which ensures the obtaining of nickel with a high hardness which is uniformly distributed all over the item, with a minimal sulphur content, which has high plasticity, and has internal stresses which are close to zero.

According to the invention this object is attained by adding to the sulphamate electrolytes an additive in concentrations from 0.1 to 4 g/l, representing a derivative of sulphamoylbenzoic acid with the general formula

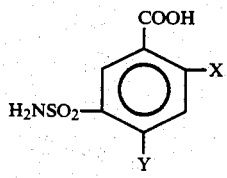

in which X, Y can be hydrogen, halogen,

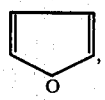

alkyl radical, or a mixture of these compounds.

The technological flow-sheet of preparing the additive is easily feasible and the yields are high. The initial, intermediate and end products are not toxic or carcinogeric. The additive dissolves entirely and rapidly in amounts considerably surpassing its operational concentration, so that its several times overdosing does not deteriorate the quality of the layer. The layers thus obtained have a Vickers hardness from 470 to 550 kg/mm$^2$, internal streses from +0.5 to −4.5 kg/mm$^2$, a plasticity measured according to the method of Rolfi-Damas of over 7%, and there are no visual defects. The invention is illustrated by the following examples:

EXAMPLE 1

An electrolyte with the following composition is used:

| | g/l |
|---|---|
| nickel sulphamate | 350 |
| boric acid | 36 |
| nickel chloride | 3 |
| alkylethersulphate | 0.1 |
| 2, 4 dichloro-5 sulphamoylbenzoic acid | 0.75 |

The layer is prepared at pH 4.4, a temperature of 43° C., and with a current density of 10 A/dm$^2$. The layer thus obtained has a hardness of 515 kg/mm$^2$, a plasticity of 10.5%, and internal stresses of 40.5 kg/mm$^2$.

EXAMPLE 2

The electrolyte composition is the same as in Example 1, while the additive is used in a concentration of 1.5 g/l.

The layer is prepared at pH 4.4, a temperature of 49° C., and a current density of 5 A/dm$^2$. It has a hardness 500 kg/mm$^2$, a plasticity of 9.5% and internal stresses of 4.5 kg/mm$^2$.

EXAMPLE 3

An electrolyte with the following composition is used:

| | g/u |
|---|---|
| nickel sulphamate | 350 |
| boric acid | 36 |
| nickel chloride | 3 |
| nonylphenolether | 0.1 |
| 2, 4 dichloro-5-sulphamoyl-6-furanylbenzoic acid | 1.5 g/l. |

The layer is prepared at pH 4, a temperature of 49° C., and a current density 15 A/dm$^2$. The coating thus obtained has a hardness of 545 kg/mm$^2$, a plasticity of 6.5%, and internal stresses of 0.6 kg/mm$^2$.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Sulphamate electrolyte for electrodepositing hard nickel layers, said electrolyte being based on nickel sulphamate, boric acid, nickel chloride, and a surface-active additive which represents a derivative of sulphamoylbenzoic acid with the general formula

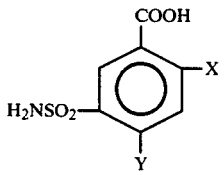

in which X an Y are chosen from a group consisting of hydrogen, halogen,

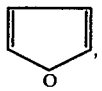

alkyl radical and a mixture of these compounds in a concentration from 0.1 to 4 g/l.

2. An electrolyte for electrodepositing hard nickel layers with the following composition:

| | g/l |
|---|---|
| nickel sulphamate | 350 |
| boric acid | 36 |
| nickel chloride | 3 |
| alkylethersulphate | 0.1 |

and a surface-active additive which represents a derivative of sulphamoylbenzoic acid with the general formula

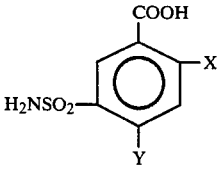

in which X and Y are chosen from a group consisting of hydrogen, halogen,

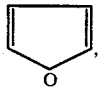

alkyl radical and a mixture of these compounds in a concentration from 0.1 to 4 g/l.

3. An electrolyte for electrodepositing hard nickel layers with the following composition:

| | g/l |
|---|---|
| nickel sulphamate | 350 |
| boric acid | 36 |
| nickel chloride | 3 |
| alkylethersulphate | 0.1 |
| 2, 4 dichloro-5 sulphamoylbenzoic acid | 0.75 |

-continued

| | g/l |
|---|---|
| acid | |

4. An electrolyte for electrodepositing hard nickel layers with the following composition:

| | g/l |
|---|---|
| nickel sulphamate | 350 |
| boric acid | 36 |
| nickel chloride | 3 |
| nonylphenolether | 0.1 |
| 2, 4 dichloro-5-sulphamoyl-6-furanyl benzoic acid | 1.5 |

5. Method of electrodepositing hard nickel layers comprising employing an electrolyte based on nickel sulphamate, boric acid, nickel chloride and a surface-active additive representing a derivative of sulphamoylbenzoic acid with general formula

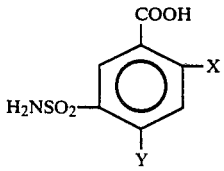

in which X and Y are chosen from a group consisting of hydrogen, halogen,

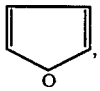

alkyl radial and a mixture of these compounds in a concentration from 0.1 to 4 g/l.

6. Method of electrodepositing hard nickel layers comprising employing an electrolyte having the following composition:

| | g/l |
|---|---|
| nickel sulphamate | 350 |
| boric acid | 36 |
| nickel chloride | 3 |
| alkylethersulphate | 0.1 |
| 2, 4 dichloro-5 sulphamoylbenzoic acid | 0.75 |

7. Method of electrodepositing hard nickel layers comprising employing an electrolyte with following composition:

| | g/l |
|---|---|
| nickel sulphamate | 350 |
| boric acid | 36 |
| nickel chloride | 3 |
| nonylphenolether | 0.1 |
| 2, 4 dichloro-5-sulphamoyl-6-furanyl benzoic acid | 1.5 |

* * * * *